US005634776A

United States Patent [19]

Leemhuis et al.

[11] Patent Number: 5,634,776

[45] Date of Patent: Jun. 3, 1997

[54] LOW NOISE HYDRAULIC PUMP WITH CHECK VALVE TIMING DEVICE

[75] Inventors: Richard S. Leemhuis, Rochester Hills, Mich.; Don G. Olmstead, Pearl, Miss.

[73] Assignee: Trinova Corporation, Maumee, Ohio

[21] Appl. No.: 575,910

[22] Filed: Dec. 20, 1995

[51] Int. Cl.[6] ..... F04B 1/20

[52] U.S. Cl. ..... 417/270; 417/312; 91/6.5; 91/28

[58] Field of Search ..... 91/6, 6.5, 28, 29, 91/474, 487, 499; 417/269, 312, 270

[56] References Cited

U.S. PATENT DOCUMENTS

| | | | |
|---|---|---|---|
| 874,034 | 12/1907 | Prellwitz . | |
| 2,020,508 | 11/1935 | Knapp . | |
| 2,020,509 | 11/1935 | Knapp . | |
| 2,382,716 | 8/1945 | Herzmark . | |
| 2,573,863 | 11/1951 | Mitchell . | |
| 2,642,809 | 6/1953 | Born et al. | 91/6.5 |
| 2,840,107 | 6/1958 | Campbell . | |
| 3,199,461 | 8/1965 | Wolf | 91/6.5 |
| 3,858,483 | 1/1975 | Hein | 91/6.5 |
| 3,934,967 | 1/1976 | Gannaway . | |
| 3,956,969 | 5/1976 | Hein | 91/6.5 |
| 4,007,663 | 2/1977 | Nagamoto et al. . | |
| 4,175,472 | 11/1979 | Roberts | 91/6.5 |
| 4,540,345 | 9/1985 | Frazer | 91/6.5 |
| 4,836,754 | 6/1989 | Ikeda et al. . | |
| 4,838,765 | 6/1989 | Wusthof et al. . | |
| 4,976,284 | 12/1990 | Hovarter . | |
| 5,052,898 | 10/1991 | Cook . | |
| 5,112,198 | 5/1992 | Skinner . | |
| 5,230,274 | 7/1993 | Yu et al. . | |
| 5,316,447 | 5/1994 | Fujie et al. . | |
| 5,354,181 | 10/1994 | Porel . | |
| 5,372,483 | 12/1994 | Kimura et al. . | |
| 5,380,165 | 1/1995 | Kimura et al. . | |
| 5,401,144 | 3/1995 | Fujie et al. . | |

FOREIGN PATENT DOCUMENTS

| | | | |
|---|---|---|---|
| 0754105 | 8/1980 | U.S.S.R. | 91/6.5 |

*Primary Examiner*—Timothy Thorpe
*Assistant Examiner*—Roland G. McAndrews, Jr.
*Attorney, Agent, or Firm*—Jones, Day, Reavis & Pogue

[57] ABSTRACT

A low noise hydraulic pump is disclosed which can be an piston pump or a vane pump, including a flow generation assembly with at least one pumping chamber for creating positive displacement of hydraulic fluid into a hydraulic system. The pump also includes a valve plate in fluid communication with the flow generation assembly, wherein the valve plate defines an inlet for admitting hydraulic fluid and also an outlet for receiving discharged hydraulic fluid. A check valve assembly is received within the valve plate for establishing a fluid passageway between the flow generation assembly and the outlet, wherein the check valve assembly reduces the pressure overshoot between the flow generation assembly and the outlet. The check valve assembly further comprises a check valve having a plurality of apertures, the apertures being sized so as to permit a predetermined flow of fluid through the check valve assembly, whereby the check valve assembly reduces noise generated by the pump.

6 Claims, 11 Drawing Sheets

$P_C > P_S$

LOW NOISE HYDRAULIC PUMP WITH CHECK VALVE TIMING DEVICE

BACKGROUND OF THE INVENTION

The present invention is directed to the field of hydraulic pumps, particularly positive displacement pumps such as axial piston pumps and vane pumps. Hydraulic systems are widely used in many power and motion control applications and offer numerous advantages such as high power density, robust performance and relatively low cost. However, hydraulic systems are often noisy. This is often a result of noise produced by the hydraulic pump. Increasingly stringent regulations limiting overall noise in the workplace have increased the need for reducing the noise generated by hydraulic pumps.

A standard axial piston pump and its operation is shown in FIGS. 1A and 1B. A plurality of pistons 10 are provided for receiving hydraulic fluid. The pistons 10 are mounted in a cylinder block 12 which is rotated by a drive shaft 14 and driven by a power source (not shown). As the cylinder block 12 rotates, the pistons 10 are alternately stroked in and out by a yoke 16 which is inclined at a particular angle, typically about 17.5° at full stroke. The pistons are in fluid communication with respective inlet and outlet ports 24, 26 which supply and receive the hydraulic fluid. As the cylinder block 12 is rotated, the piston 10 retracts, expanding the pumping chamber 18. Fluid is drawn in to the pumping chamber 18 from inlet port 24 through valve block 28. The pistons 10 reach their maximum extent at bottom dead center (BDC), after which the pistons 10 extend, collapsing the pumping chamber 18 and thereby discharging the fluid through the valve block 28 into the outlet port 26.

The cylinder block 12 is fluidly connected to the inlet and outlet ports 24, 26 through a valve plate 30 which includes respective inlet and outlet kidney slots 32, 34. The structure and operation of a typical valve plate 30 is shown in FIGS. 2A and 2B. During operation, the rotating pistons 10 draw in hydraulic fluid through the inlet kidney slot 32, the fluid being typically supplied at atmospheric pressure. After the pumping chamber 18 is closed to the inlet 32, it passes BDC, compressing the fluid and discharging the fluid into the outlet kidney slot 34 where it is supplied to the hydraulic system. Such valve plates are advantageous since a variety of valve plates can be interchangeably used to optimize pump operation for a number of different operating conditions.

As the fluid in the pumping chamber is compressed in the transition zone around BDC, the hydraulic fluid reaches a particular chamber pressure (Pc), after which it is discharged through the outlet 34 and into a hydraulic system having a particular system pressure (Ps). However, overpressurization or underpressurization of the piston chamber relative to the hydraulic system has been identified as a source of noise in the hydraulic pump. As seen in FIGS. 3A, an overpressurized piston chamber produces a pressure "overshoot" upon opening to the outlet 34. This overshoot results in a shock which is equivalent to an impact in the system thus producing an audible noise. As seen in FIG. 3B, a very large difference in pressurization produces a large overshoot which results in a louder noise. An underpressurization, as seen in FIG. 3C, also produces noise as the rate of pressure change within the piston chamber is abrupt, and the higher system pressure impacts into the piston chamber. Ideal system operation occurs at conditions where the chamber pressure is equal to system pressure, as shown at FIG. 3D, where the pressure overshoot is zero and the rate of pressure change within the piston chamber is not high.

In order to insure optimally quiet operation, the chamber pressure of the hydraulic pump should be matched to the system pressure. However, several variable factors can affect the pressure profile. Hydraulic pumps can be driven over a wide range of speeds. As the shaft 14 rotates faster, the pistons 10 displace a greater volume of fluid per unit time. Secondly, flow can also be varied by stroke, i.e., the length of piston displacement as determined by the angle of the yoke 16. The yoke 16 can be varied between maximum pitch (to produce maximum piston displacement) and a pitch of zero (to produce zero piston displacement) using the control piston 20 and the bias piston 22. The piston displacement corresponds to the volume of fluid displaced, hence the rate of flow. The third factor that affects pressure within the pumping chamber is hydraulic fluid temperature variation, since it changes the bulk modulus (fluid stiffness) of the fluid.

These variables affect chamber pressurization, thus increasing the noise level during operation when the chamber pressure does not match system pressure as the outlet port opens. However, system pressure may also vary within a hydraulic system over the course of a particular operation. Thus, it is not uncommon for the chamber and system pressures to be unmatched over the majority of variable operational conditions, resulting in generally noisy operation in a standard hydraulic pump.

Noise arises in the pump from deflections in the various components such as the valve block, housing, yoke, and drive shaft. These result from pressure-related forces in the pumping chamber. These deflections are harmonics of the piston pumping frequency. Thus, noise increases in pitch with increased pump speed.

Another source of pump housing vibration is "yoke flutter," an oscillation in the yoke 16 produced by the reciprocating forces of the pistons 10 against the yoke 16. As seen from FIG. 4, each piston 10 applies a moment to the yoke 16 which slightly alters the yoke's pitch and subsequently the stroke of the pistons. Yoke oscillations produce a "pitching" which causes deflections in the pump housing, thereby generating noise. The level of noise is proportional to the magnitude of the change in the yoke moment. The curve 40 shows that for a typical yoke arrangement, the moment can vary by several hundred inch-pounds as a function of chamber angle past bottom dead center (where pumping chamber volume is maximum). The curve 40 also repeats itself over every 360/n degrees of chamber angle, where n is the number of pistons.

Many hydraulic pumps use bushings to support the yoke 16. These bushings tend to have high friction which minimize oscillation of the yoke. Such pumps produce lower levels of noise. However, such bushings are not desirable for pumps which need to make rapid stroke changes. For example, certain injection molding equipment requires a yoke 16 which can vary from zero flow to full flow in several tens of milliseconds. Such a yoke is typically mounted on low-friction roller bearings which permit high speed changes. However, such bearings also permit unwanted displacement variations resulting from yoke moments. The low friction bearings result in a higher level of oscillation, and thus increased levels of noise.

A preferable method of reducing noise is to reduce the alternating forces that produce the deflections in the pump components and the oscillations of the yoke. This is done by using a metering groove 38, as shown in FIGS. 2A and 2B. The metering groove extends into the transition region around BDC and creates a fluid passageway between the piston chamber and the outlet 34. During the standard operation of a hydraulic pump, the piston chamber 18 is "mechanically" pressurized by the forward motion of the pumping piston. As the metering groove 38 meters oil between the chamber and the outlet 34, the pumping chamber is also "hydraulically" pressurized. Thus, the pressure differential between the chamber and the system is equalized, reducing overshoot and the noise produced thereby.

The pressure profile shape is controlled by the shape of the metering groove 38. The design of the grooves is referred to as "pump timing." In addition to overshoots and undershoots as a source of noise, a high rate of pressure change is sufficient to provide a large amount of energy that tends to excite structural resonances, thereby producing noise. Thus, it is also important to control the rates of pressurization so as to control the spectral content of the forcing functions exciting resonances in the pump components. By carefully designing the metering groove 38, the pump timing can be designed to control pressurization so as to produce a minimum rate of pressure change in addition to a minimum overshoot. However, pump timing design can only be "tuned" for a particular pump speed, system pressure and pump stroke. Since these quantities are variables, any low noise pump design must necessarily be a compromise, since a pump must be capable of operating over a wide range of conditions.

SUMMARY OF THE INVENTION

In view of the difficulties and drawbacks resulting from previous hydraulic pumps, it would be advantageous to provide a hydraulic pump which solves the previous problems while providing a more robust and more versatile pump design.

Therefore, there is a need for a hydraulic pump which operates with a reduced level of noise.

There is also a need for a hydraulic pump which offers a broader range of timing over a wide range of pump speeds, temperatures, system pressures and piston displacements.

There is also a need for a hydraulic pump including a metering arrangement which permits variable metering of hydraulic fluid.

There is also a need for a hydraulic pump with changeable metering to optimize for different conditions without changing the entire valve plate.

These needs and others are realized by the hydraulic pump of the present invention which includes a flow generation assembly including at least one pumping chamber for creating positive displacement of hydraulic fluid into a hydraulic system. The flow generation assembly can be the components of piston pump, a vane pump, or any other type of positive displacement hydraulic pump.

A valve plate is in fluid communication with said flow generation assembly, wherein said valve plate defines an inlet for admitting hydraulic fluid and also an outlet for receiving discharged hydraulic fluid. A check valve assembly is received within said valve plate for establishing a fluid passageway between the flow generation assembly and the outlet. The check valve assembly reduces the pressure overshoot between the flow generation assembly and the outlet.

The check valve assembly further comprises a check valve having a plurality of apertures, said apertures being sized so as to permit a predetermined flow of fluid through the check valve assembly, whereby the check valve assembly reduces noise generated by the pressure differential between the flow generation assembly and the outlet.

As will be appreciated, the invention is capable of other and different embodiments, and its several details are capable of modifications in various respects, all without departing from the invention. Accordingly, the drawings and description are to be regarded as illustrative in nature and not restrictive.

BRIEF DESCRIPTION OF THE DRAWINGS

The embodiments of the invention will now be described by way of example only, with reference to the accompanying figures wherein like members bear like reference numerals and wherein.

DETAILED DESCRIPTION OF THE INVENTION

Figure 1A:
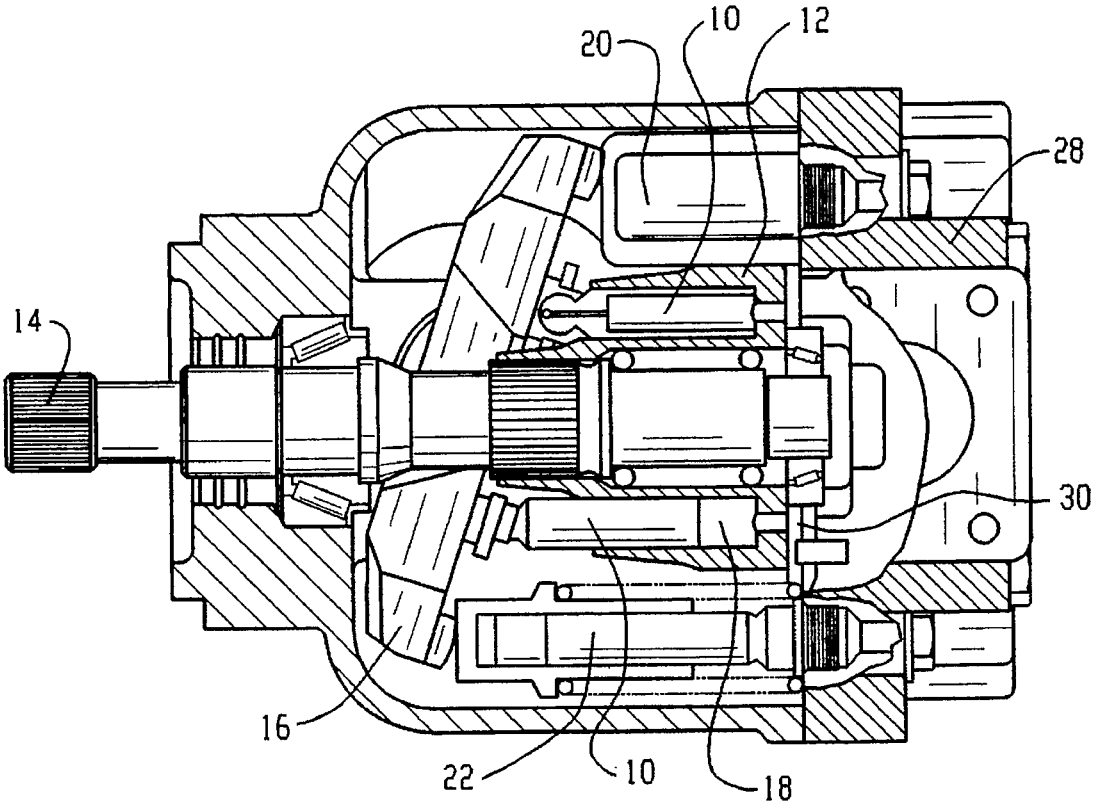
Fig. 1A (PRIOR ART)
FIGS. 1A and 1B are sectional views respectively illustrating the configuration and operation of a standard axial hydraulic piston pump.
Figure 1B:
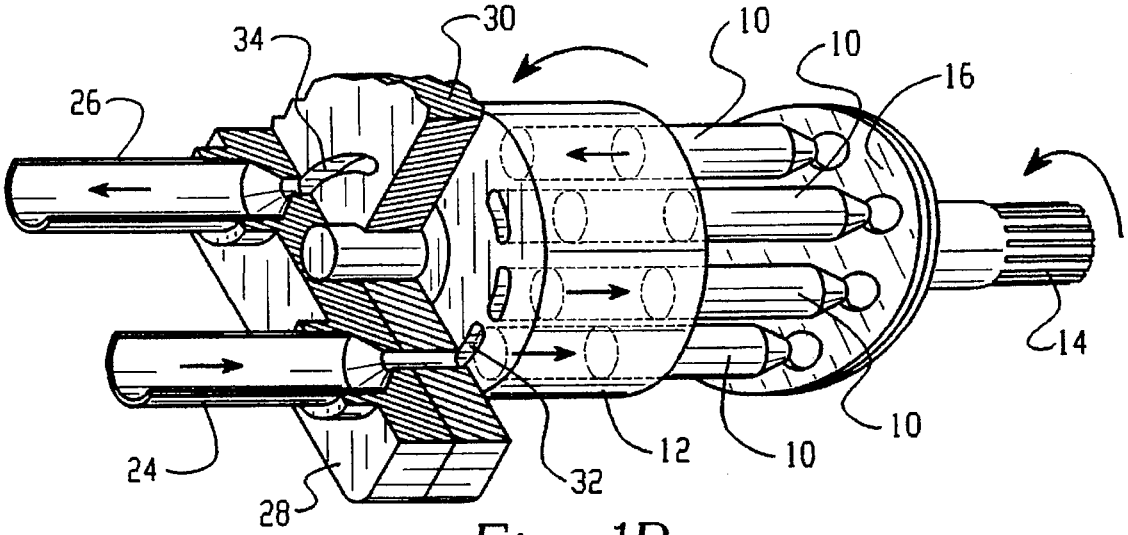
Fig. 1B (PRIOR ART)
Figure 2A:
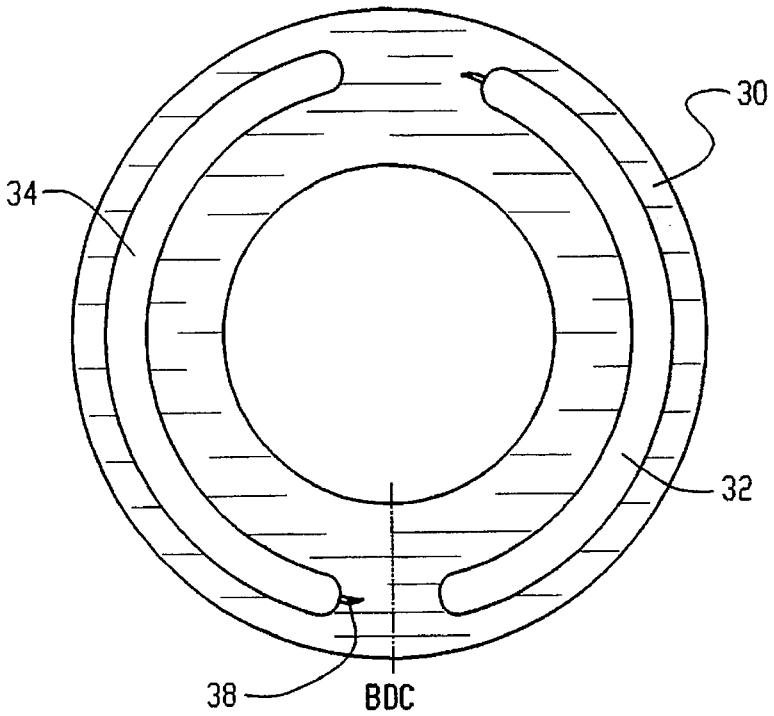
Fig. 2A (PRIOR ART)
FIGS. 2A and 2B are respectively frontal and oblique views showing the configuration and operation of a standard hydraulic valve plate.
Figure 2B:
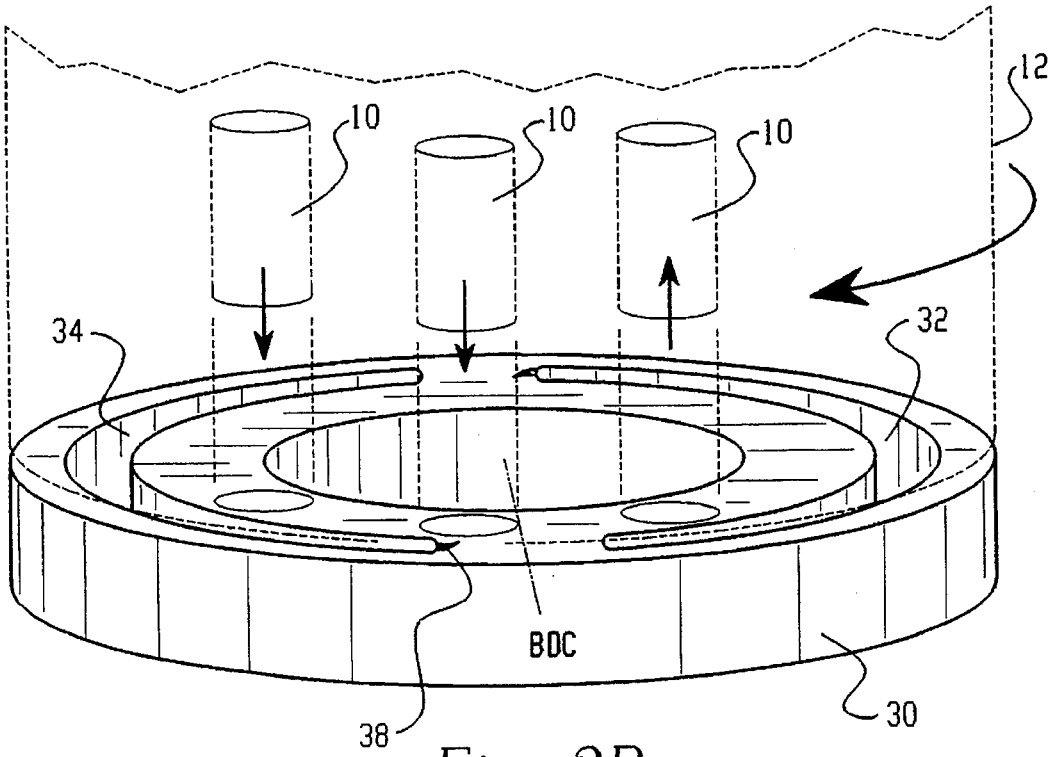
Fig. 2B (PRIOR ART)
Figure 3A:
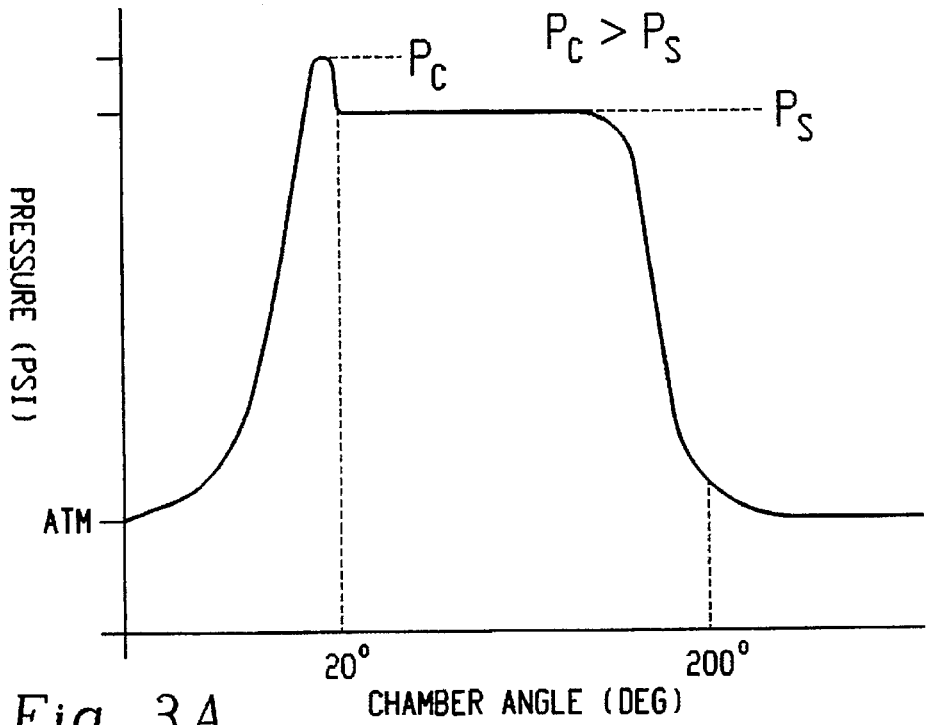
Fig. 3A (PRIOR ART)
FIGS. 3A, 3B, 3C and 3D are graphs depicting various pressure profiles that occur between the piston chamber and the hydraulic system in a standard hydraulic pump, measured as a function of chamber angle where bottom dead center equals zero.
Figure 3B:
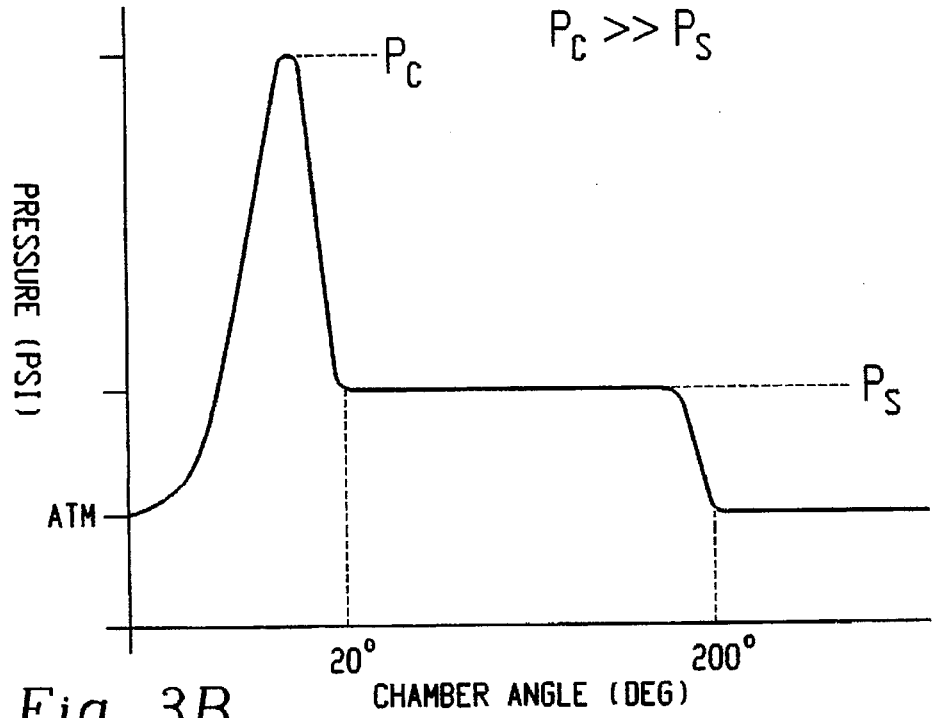
Fig. 3B (PRIOR ART)
Figure 3C:
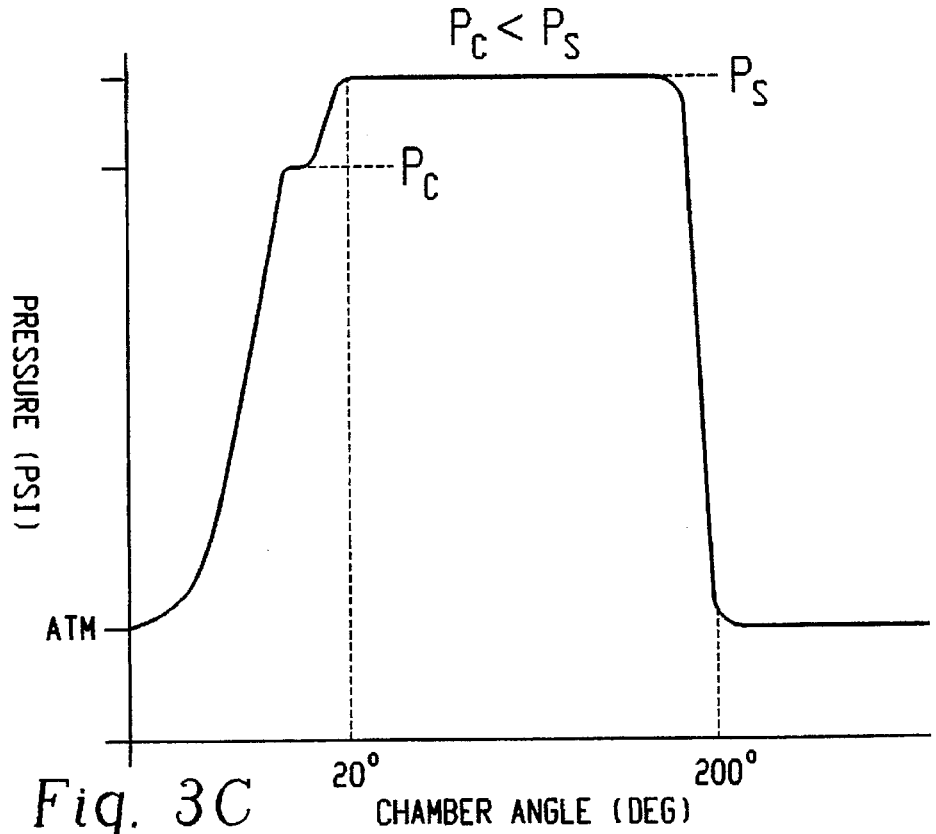
Fig. 3C (PRIOR ART)
Figure 3D:
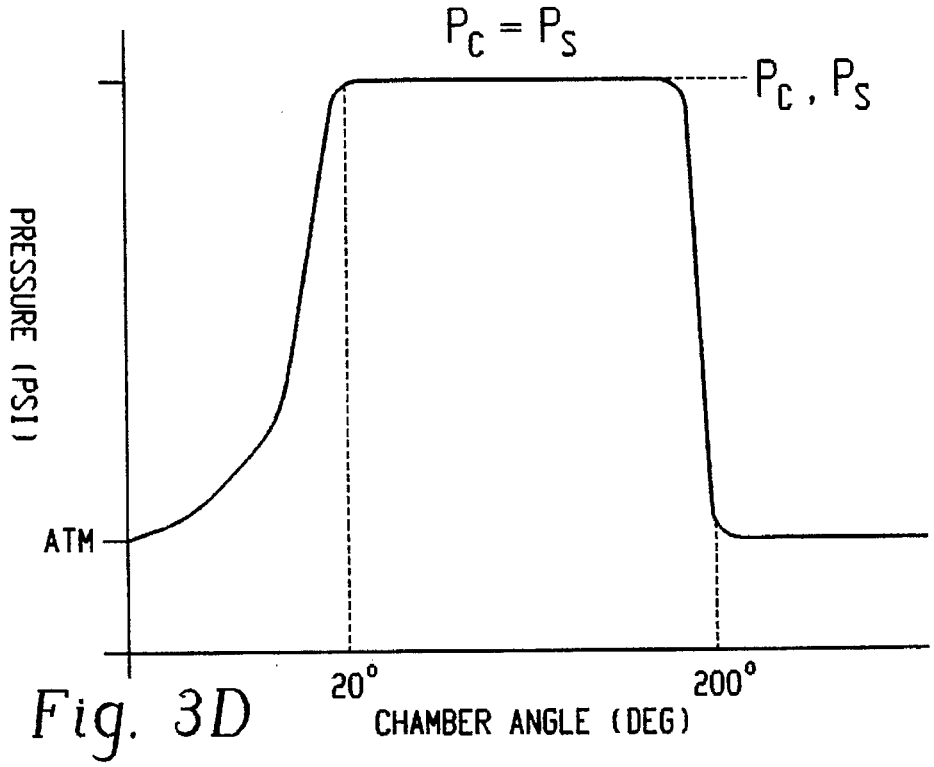
Fig. 3D (PRIOR ART)
Figure 4:
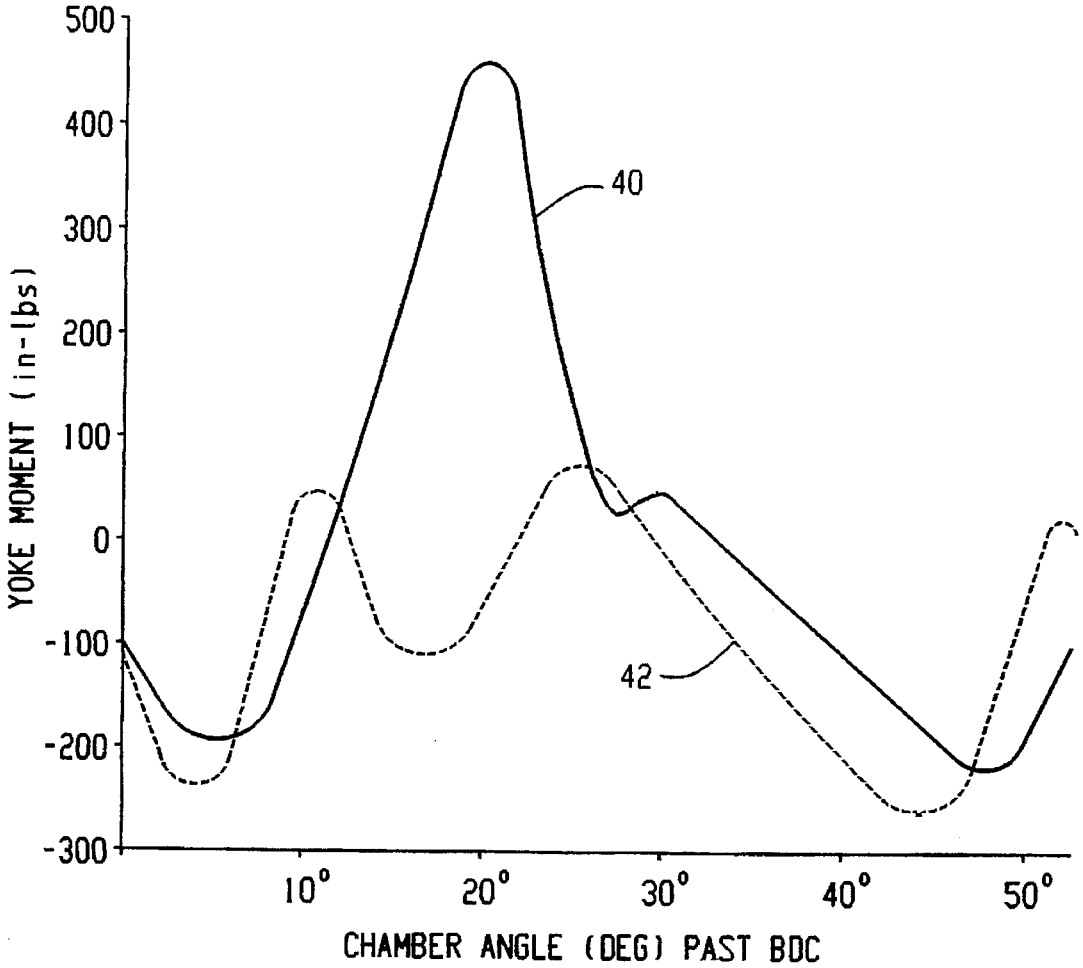
Fig. 4 (PRIOR ART)
FIG. 4 is a graph depicting the yoke moments of a standard hydraulic pump and the same pump with a check valve as according to the present invention, measured as a function of chamber angle past bottom dead center.
Figure 5:
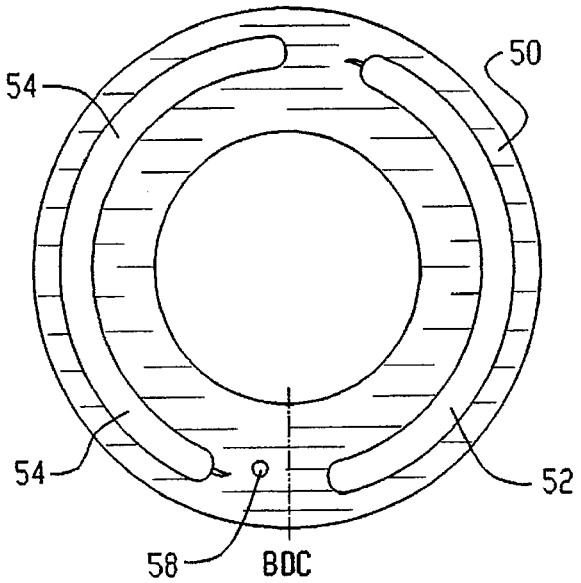
FIG. 5 is a frontal view showing a valve plate with a check valve assembly as according to the present invention.
Figure 6:
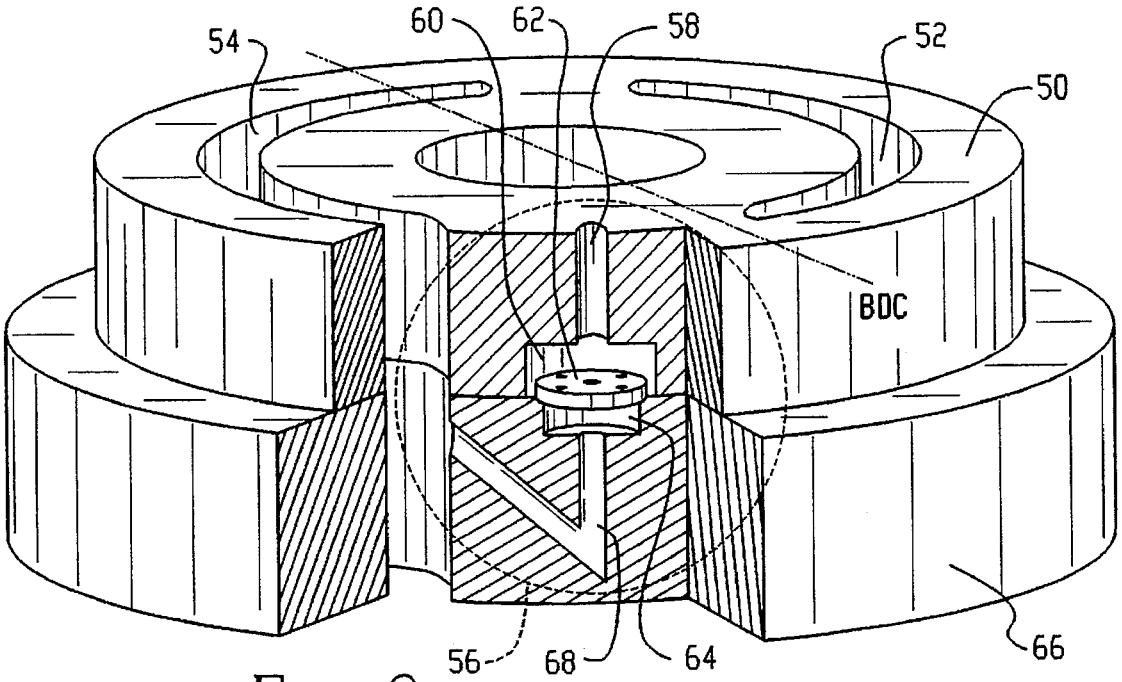
FIG. 6 is an oblique sectional view detailing the check valve timing device according to a first embodiment of the present invention.

Referring now to the drawings which are for purposes of illustrating only the preferred embodiment of the present invention and not for purposes of limiting the same, the figures show an axial piston hydraulic pump including a check valve timing device for reducing the noise produced by pressure profiles. However, the present invention may also be used in other positive displacement pumps, such as vane pumps. FIGS. 5 and 6 illustrate a valve plate 50 as according to a first embodiment of the present invention having a check valve assembly 56 with a communicating hole 58 located in the transition region in between the inlet 52 and the outlet 54 just past bottom dead center. The communicating hole 58 is fluidly connected to a check valve seat 60, formed on the bottom of the valve plate 50, in order to receive a check valve 62. The check valve seat 60 is substantially sized to be slightly larger than the check valve 62 so as to permit reciprocating movement of the check valve 62 within the seat. The check valve seat 60 is opened to a check valve pocket 64 formed on a mating surface of the valve block 66 of the hydraulic pump. The check valve pocket 64 is made smaller than the check valve seat 60 so as to permit the check valve 62 to rest along the surface of the valve block 66. A fluid passageway 68 is formed in the valve block 66, fluidly connecting the check valve pocket 64 to the outlet 54. As will be shown, the check valve assembly 56 defines a controllable fluid passage for equalizing fluid pressures between the piston in the transition region and the outlet 54, thus reducing noise levels during operation.

Figure 7:
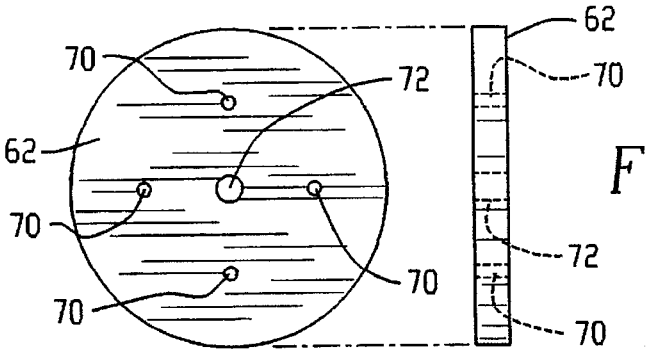
FIG. 7 is a frontal and side view showing the check valve as according to the present invention.

A detail of the check valve 62 is shown in FIG. 7. The check valve 62 is preferably a thin disc having a plurality of apertures 70 located concentrically around an aperture 72 at the center of the disc. As will be shown, these respective apertures 70, 72 are selectively sized so as to establish a desired flow rate through the check valve assembly 56.

Figure 9A:
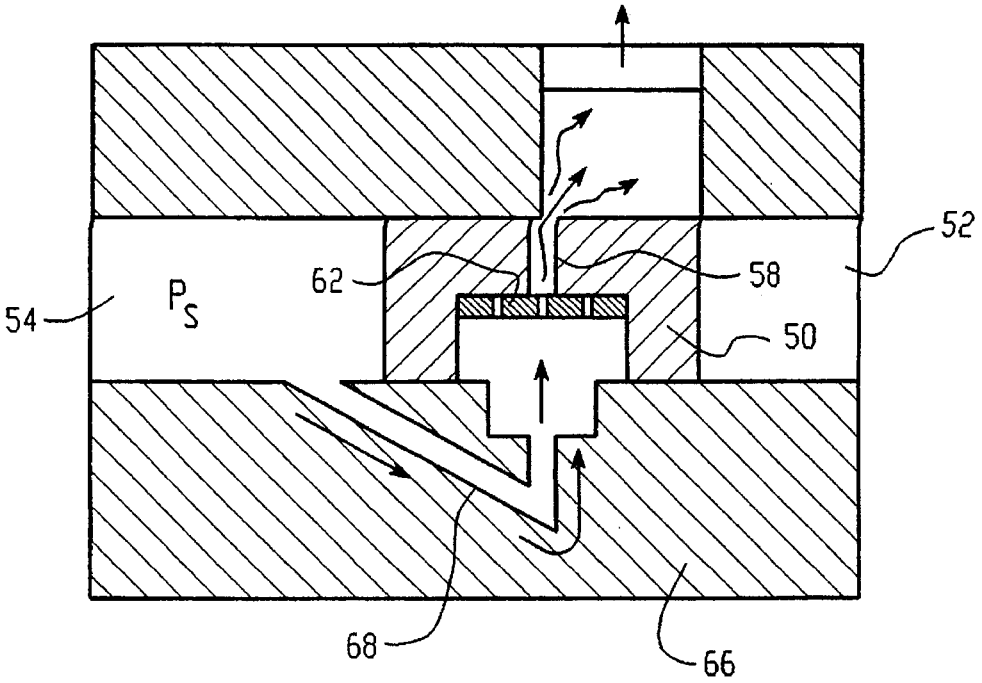
FIGS. 9A, 9B, 9C and 9D are side sectional views illustrating the operation a hydraulic pump including the check valve timing device according to the first embodiment of the present invention.

The operation of the hydraulic pump with the check valve assembly 56 of the present invention is shown especially by FIGS. 9A–D. As seen in FIG. 9A, the pumping chamber opens to the communicating hole 58 as soon as it closes to the inlet 52. Since the chamber is typically at a lower chamber pressure at this position than the outlet 54, the hydraulic fluid flows through the passageway 68 and presses the check valve 62 against the valve plate 50. At this point, the concentric apertures 70 are blocked and fluid only flows through the central aperture 72, through the communicating hole 58, to pressurize the pumping chamber.

Figure 9B:
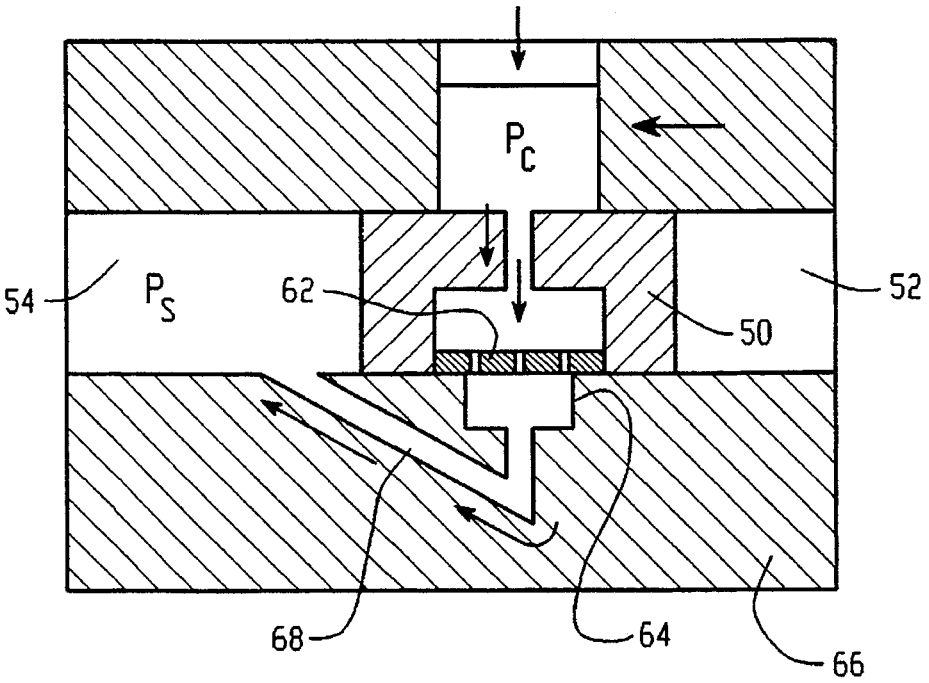

As the piston chamber contracts, the fluid becomes mechanically compressed. If the chamber pressure exceeds the system pressure (as shown in FIG. 9B) the chamber fluid presses the check valve 62 downward, permitting the fluid to flow through all of the apertures 70, 72 into the check valve pocket 64. In this way, a large quantity of fluid is permitted to flow toward the outlet 54, equalizing the chamber pressure to the system pressure at a steady rate, reducing pressure overshoot and the other rapid changes in pressure that create noise-generating deformations of the pump components and the "pitching" from the oscillation of the yoke along its bearing axis.

Figure 9C:
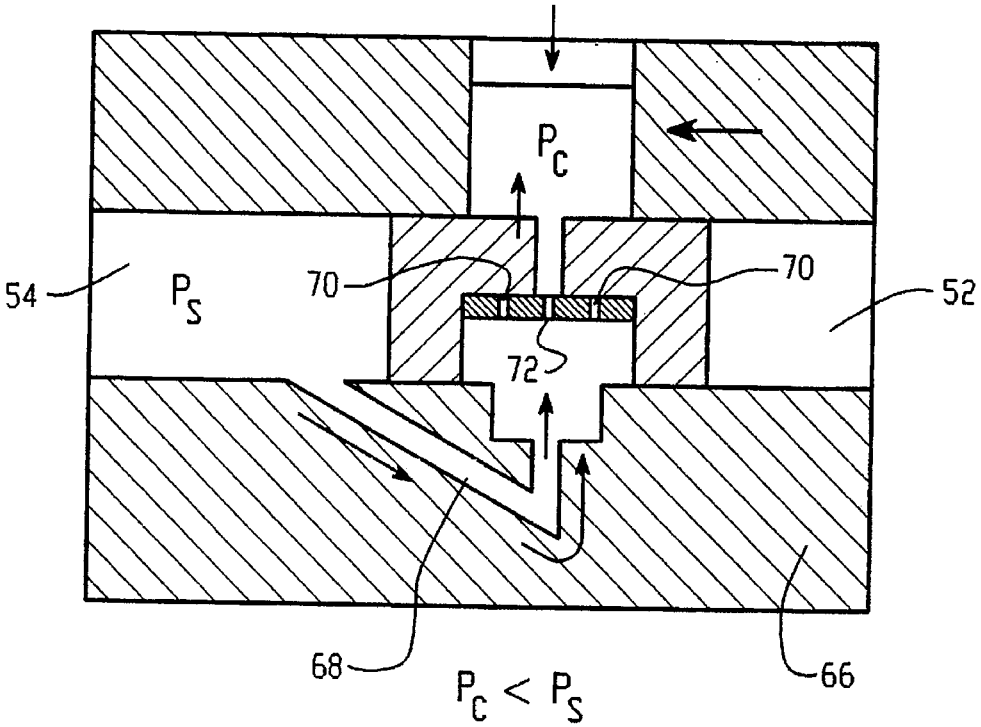
Figure 9D:
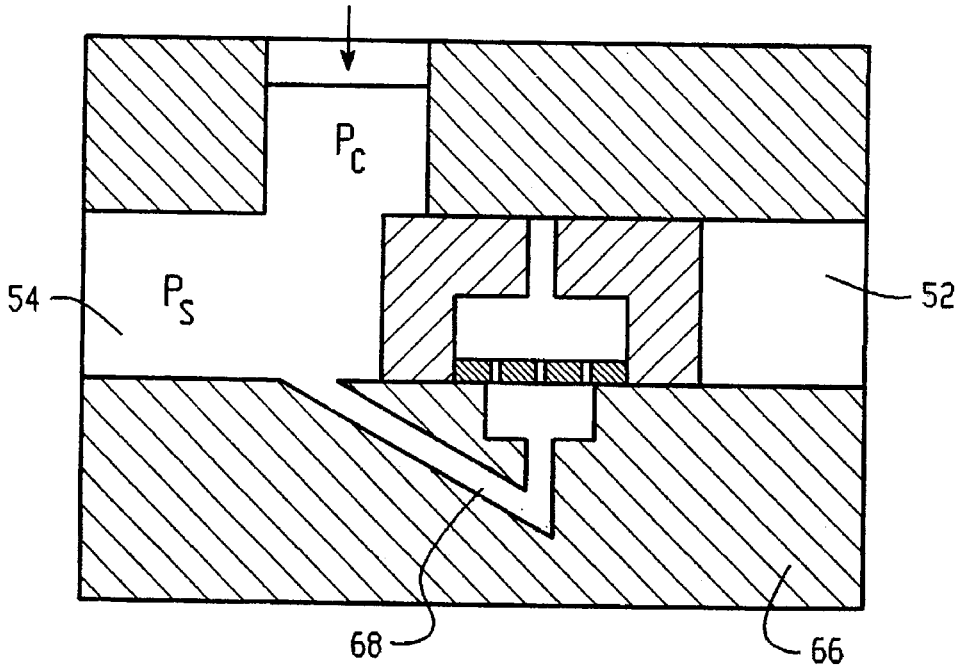

As shown in FIG. 9C, the present check valve assembly 56 continues to pressurize the piston chamber in the event that chamber pressure remains lower than system pressure during mechanical compression of the fluid. Since only the central aperture 72 is opened to the communicating hole 58, only a small amount of fluid is permitted to pass, thus metering the rate that the cylinder is pressurized. In any event, the present check valve assembly reduces overshoots so that the system pressure and chamber pressure are substantially equalized at the point of piston discharge, as shown in FIG. 9D.

Figure 10:
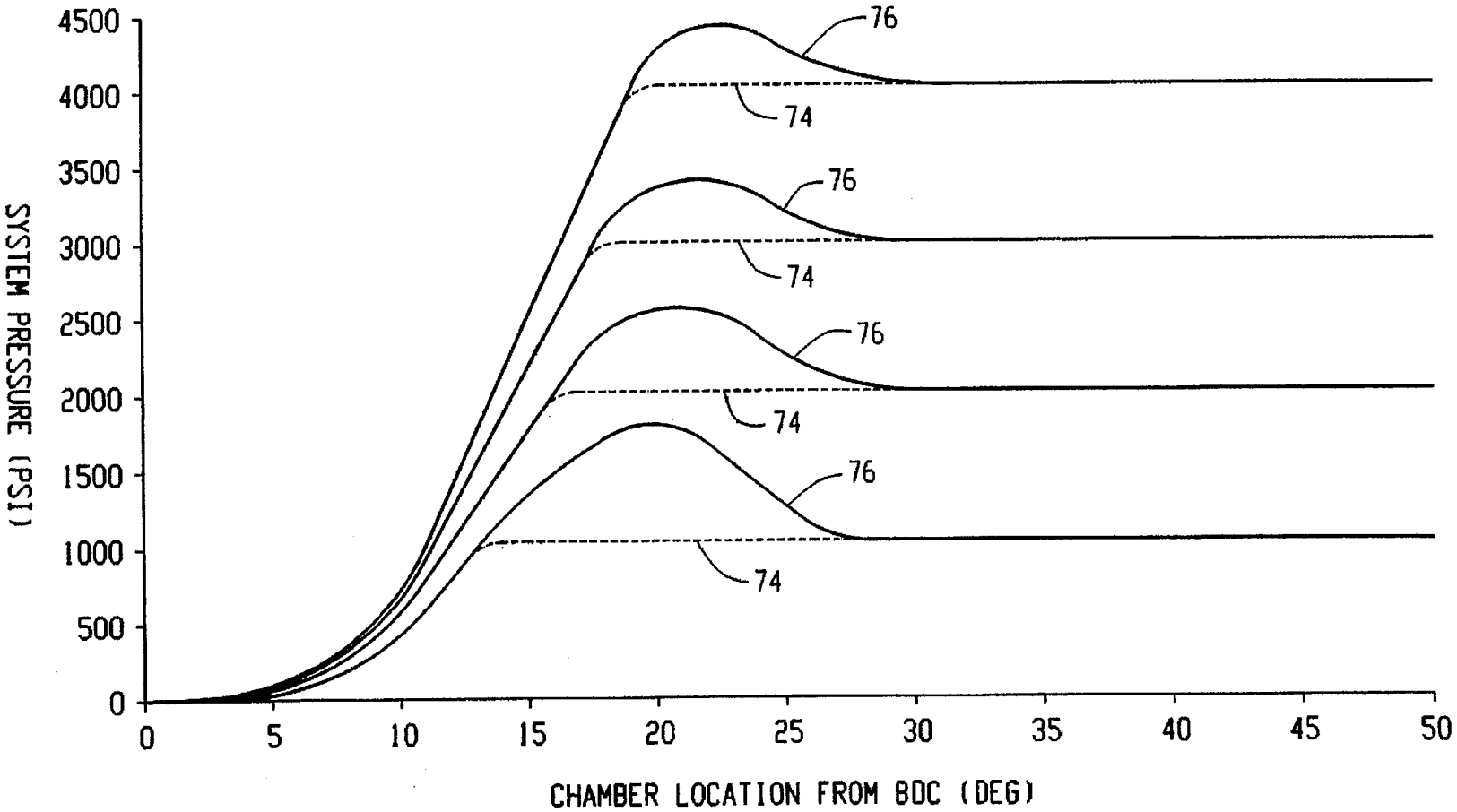
FIG. 10 is a graph which compares pressure profiles for a pump respectively with or without the check valve timing device according to the present invention.
Figure 11:
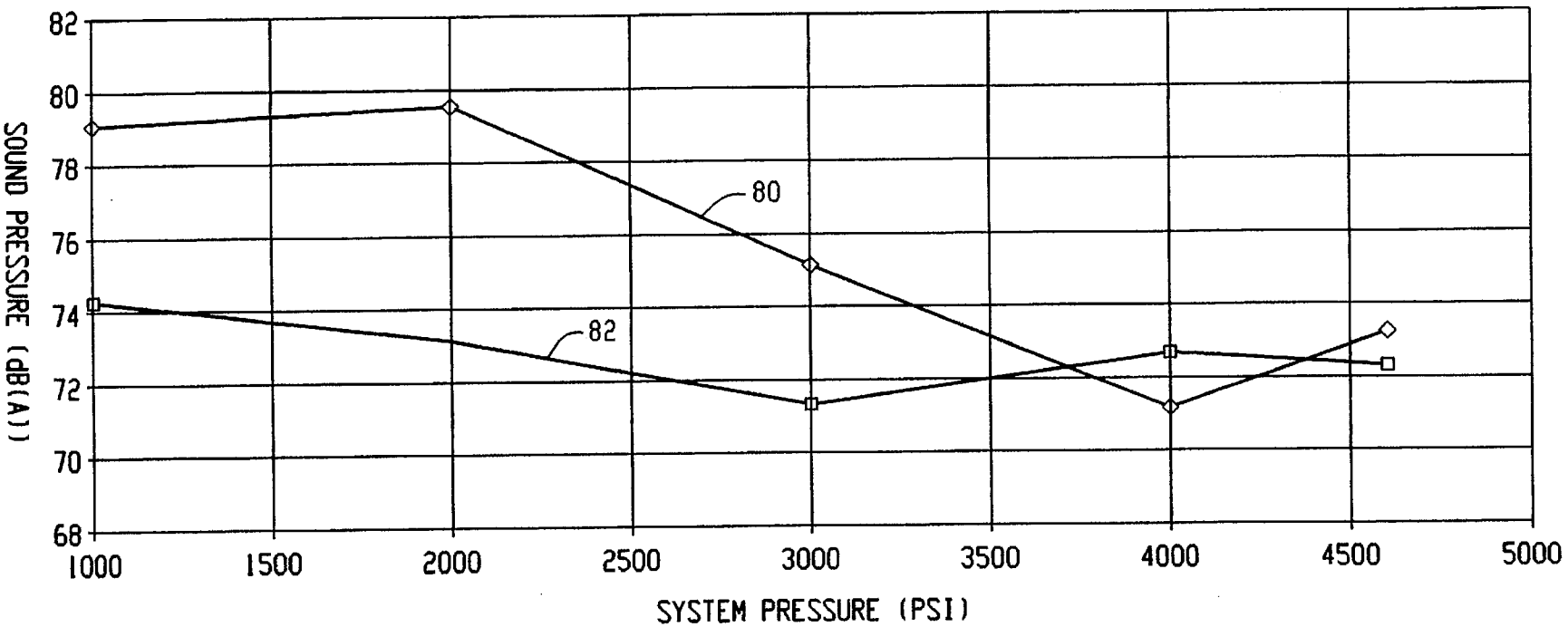
FIG. 11 is a graph comparing the sound profiles as a function of system pressure for a hydraulic pump and the same pump including the check valve timing device according to the present invention.

The apertures 70, 72 in the check valve 62 can be sized to optimize pump timing for a particular set of pump operating conditions. As shown in FIG. 10, the pressure curves 74 of a pump using an appropriately selected check valve have significantly reduced overshoots over a variety of system conditions as compared with the pressure curves 76 of a pump without the check valve. Applicant has observed that a 0.024" check valve aperture optimizes pump timing for a Vickers PVK45 pump operating at 4,000 psi, 1200 RPM, full stroke. Additionally, this size check valve 62 significantly reduces pressure overshoots for operating pressures other than the optimization pressure, thereby reducing overall noise levels. FIG. 11 shows the sound level plot 80 for a VICKERS pump using an 0.024" metering hole which opens when the pumping chamber is at BDC. A pump with a 0.024" metering hole at the same location but having the check valve assembly of the present invention has a sound level plot 82 which indicates that noise levels are reduced for system pressures under 4000 psi. Thus, the present check valve assembly significantly reduces sound levels over that obtainable with previous timing arrangements.

Further, for applications where multiple optimizations in operations are required in the same pump, it is only necessary to change the check valve rather than the entire valve plate as had been required of pumps using metering grooves. Of course, a pump design could also include the combination of a metering groove and a check valve assembly in order to obtain a desired timing configuration. Also, the check valve 62 can also be located at the inlet port, near top dead center, in order to reduce pressure undershoots at the inlet.

Figure 8A:
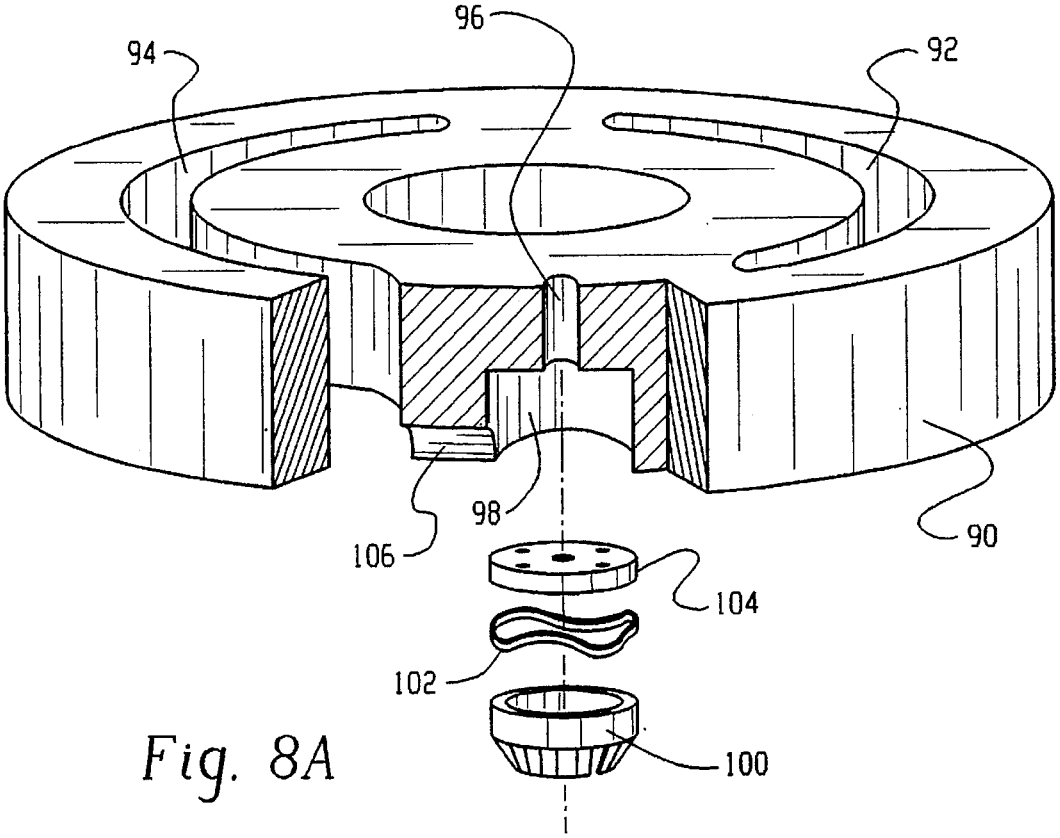
FIGS. 8A and 8B are respectively sectional and exploded sectional views detailing a valve plate with the check valve assembly according to a second embodiment of the present invention.
Figure 8B:
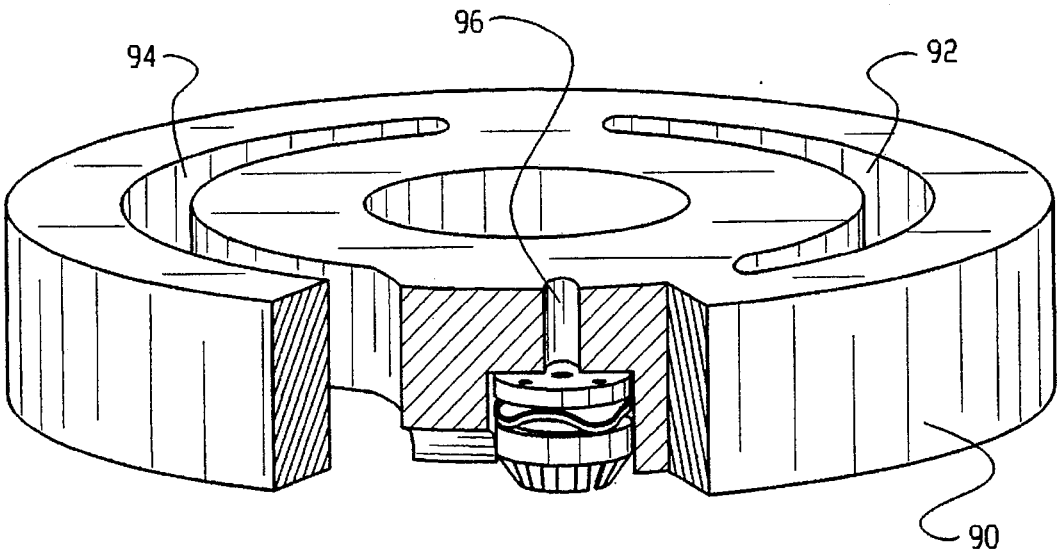

A second embodiment of the present invention is shown in FIGS. 8A and 8B. The valve plate 90 includes a communicating hole 96 which defines a fluid connection to a check valve seat 98. A check insert 100 receives a wave washer 102 within a cavity upon which rests the check valve 104. The check insert 100 is then inserted into the check valve seat 98, thereby retaining the check valve 104. The wave washer 102 urges the check valve 104 toward the valve plate 90. With the wave washer 102, the check valve 104 will only move away from the valve plate 90 when the pressure overshoot is large enough to overcome the spring force of the wave washer. This eliminates extraneous motion of the check valve, thus reducing wear. Of course, it will be appreciated that a wave washer 102 could also be used with a check valve assembly as according to the first embodiment for the same purpose of reducing wear on the check valve. The check insert 100 includes a fluid passage which fluidly connects to a feed groove 106. In this way a fluid passage is defined connecting the communicating hole 96 to the valve plate outlet 94. This embodiment provides a compact unit and eliminates the need for drilled holes in the valve block, as in the first embodiment.

As described hereinabove, the present invention solves many problems associated with the previous hydraulic pump designs, and presents a pump which reduces noise levels. However, it will be appreciated that various changes in the details, materials and arrangements of parts which have been herein described and illustrated in order to explain the nature of the invention may be made by those skilled in the art within the principle and scope of the invention as expressed in the appended claims.

What is claimed:

1. A hydraulic pump comprising:

a flow generation assembly including at least one pumping chamber for creating positive displacement of hydraulic fluid into a hydraulic system;

a valve plate in fluid communication with said flow generation assembly, wherein said valve plate defines an inlet for admitting hydraulic fluid and also an outlet for receiving discharged hydraulic fluid;

a check valve assembly, in fluid communication with said valve plate, for establishing a fluid passageway between the flow generation assembly and the outlet, wherein said check valve assembly reduces pressure overshoot between the flow generation assembly and the outlet; and wherein the check valve assembly further comprises a check valve having a plurality of apertures, said apertures being sized so as to permit a predetermined flow of fluid through the check valve assembly, thus metering fluid flow, so as to equalize chamber pressure to system pressure, whereby the check valve assembly reduces noise generated by the pressure differential between the flow generation assembly and the outlet;

wherein the check valve assembly includes first and second positions for receiving said check valve, wherein at the first position, all of said plurality of apertures are open, and wherein at the second position, some of the apertures are blocked, so as to provide directional variation in the metering of fluid flow.

2. The hydraulic pump of claim 1 wherein the pump is an axial piston pump and the check valve assembly is located near bottom dead center between the inlet and the outlet.

3. The hydraulic pump of claim 1 wherein the pump is an axial piston pump and the check valve assembly is located near top dead center between the inlet and the outlet.

4. The hydraulic pump of claim 1 wherein the check valve assembly further comprises:

a check valve seat formed within the valve plate for receiving and retaining the check valve;

a communicating hole, formed in said valve plate, for fluidly connecting a transitioning pumping chamber and the check valve seat;

a check valve pocket formed within a valve block of the flow generation assembly and fluidly connected to the check valve seat;

a fluid passageway, formed in said valve block, for fluidly connecting the check valve pocket and the outlet;

wherein the communicating hole is smaller than the check valve pocket such that some of said plurality of apertures are blocked during flow toward the pumping chamber and wherein all of said plurality of apertures are open during flow away from the pumping chamber.

5. The hydraulic pump of claim 1 wherein the check valve assembly further comprises:

a check insert received within said valve plate and having a cavity for receiving and retaining said check valve;

a wave washer received in said cavity between the check insert and the check valve for urging said check valve toward the valve plate;

a communicating hole formed in the valve plate for fluidly connecting the pumping chamber with the check insert cavity;

a feed groove, formed in the valve plate, for fluidly connecting the check insert to the outlet;

wherein the communicating hole is smaller than the check insert cavity such that some of said plurality of apertures are blocked during flow toward the pumping chamber and wherein all of said plurality of apertures are open during flow away from the pumping chamber.

6. The hydraulic pump of claim 1 wherein the check valve is moved to the first position by fluid flow away from the pumping chamber and wherein the check valve is moved to the second position by fluid flow toward the pumping chamber, wherein the check valve meters the rate that the pumping chamber is pressurized.

* * * * *